US009822793B2

(12) United States Patent
Sezal et al.

(10) Patent No.: US 9,822,793 B2
(45) Date of Patent: Nov. 21, 2017

(54) CENTRIFUGAL COMPRESSOR WITH TWISTED RETURN CHANNEL VANE

(71) Applicant: Nuovo Pignone Srl, Florence (IT)

(72) Inventors: Ismail Sezal, Bayern (DE); Christian Aalburg, Bayern (DE); Vittorio Michelassi, Bayern (DE); Giuseppe Sassanelli, Florence (IT)

(73) Assignee: Nuovo Pignone Srl, Florence (IT)

( * ) Notice: Subject to any disclaimer, the term of this patent is extended or adjusted under 35 U.S.C. 154(b) by 244 days.

(21) Appl. No.: 14/441,082

(22) PCT Filed: Nov. 5, 2013

(86) PCT No.: PCT/EP2013/073049

§ 371 (c)(1),
(2) Date: May 6, 2015

(87) PCT Pub. No.: WO2014/072288

PCT Pub. Date: May 15, 2014

(65) Prior Publication Data

US 2015/0300369 A1 Oct. 22, 2015

(30) Foreign Application Priority Data

Nov. 6, 2012 (IT) ..... CO2012A0055

(51) Int. Cl.
*F04D 29/44* (2006.01)
*F04D 17/12* (2006.01)
*F04D 29/42* (2006.01)

(52) U.S. Cl.
CPC ..... *F04D 29/441* (2013.01); *F04D 17/122* (2013.01); *F04D 29/4206* (2013.01)

(58) Field of Classification Search
CPC ... F04D 17/122; F04D 29/4206; F04D 29/441
See application file for complete search history.

(56) References Cited

U.S. PATENT DOCUMENTS 3,986,791 A * 10/1976 Paciga ..... F04D 1/06 415/199.2
4,579,509 A * 4/1986 Jacobi ..... F01D 17/143 415/199.1

(Continued)

FOREIGN PATENT DOCUMENTS

CN 2769572 Y 4/2006
CN 201896763 U 7/2011

(Continued)

OTHER PUBLICATIONS

Pfleiderer, "The Guiding Devices", The Centrifugal Pumps for Liquids and Gases, vol. No. 14, pp. 352-387, 1961.
Unofficial English Translation of Italian Research Search Report and Written Opinion issued in connection with Related IT Application No. FI2013A000208 dated May 27, 2014.
PCT Search Report and Written Opinion issued in connection with Related PCT Application No. PCT/EP2014/068620 dated Nov. 3, 2014.

(Continued)

*Primary Examiner* — Igor Kershteyn
(74) *Attorney, Agent, or Firm* — GE Global Patent Operation

(57) ABSTRACT

Three-dimensional (3D) return vane for a multistage centrifugal compressor. The return channel vane extends upstream to a region proximate the bend apex of the return channel. In each point of the return channel vane, the angle "beta" is defined as the acute angle between the tangent to the local camberline and the local circumferential direction. At each normalized position between leading edge and trailing edge, the local twist of the return channel vane is defined as the algebraic difference between the angles beta at the two points at hub and shroud having said normalized position. When moving in streamwise direction from leading edge to trailing edge, the twist first decreases, reaching an algebraic minimum, then increases, reaching an algebraic maximum, then decreases again. However, the absolute twist of the algebraic minimum is larger than the absolute twist of the algebraic maximum.

19 Claims, 10 Drawing Sheets

(56) References Cited

U.S. PATENT DOCUMENTS

| | | | | |
|---|---|---|---|---|
| 4,645,419 | A * | 2/1987 | Furuya | F04D 17/122 415/208.2 |
| 6,595,746 | B1 | 7/2003 | Goto et al. | |
| 2010/0272564 | A1 | 10/2010 | Richter et al. | |

FOREIGN PATENT DOCUMENTS

| | | | |
|---|---|---|---|
| EP | 0301285 | A1 | 2/1989 |
| FR | 2958346 | A1 | 10/2011 |
| JP | H10331793 | A | 12/1998 |
| JP | 2002106487 | A | 4/2002 |
| JP | 2004150404 | A | 5/2004 |
| JP | 2012102712 | A | 5/2012 |

OTHER PUBLICATIONS

International Search Report and Written Opinion dated Dec. 5, 2013 which was issued in connection with PCT Patent Application No. PCT/EP2013/073049 which was filed on Nov. 5, 2013.

Veress, A., van den Braembussche, R., Inverse Design and Optimization of a Return Channel for Multistage Centrifugal Compressor, Journal of Fluids Engineering, vol. 126, pp. 799-806 (2004).

Italian Search Report and Written Opinion dated Jul. 23, 2013 which was issued in connection with Italian Patent Application No. CO2012A000055 which was filing on Nov. 6, 2012.

Unofficial English Translation of Chinese Office Action issued in connection with Related CN Application No. 01480049025.9 dated Mar. 31, 2017.

* cited by examiner

CENTRIFUGAL COMPRESSOR WITH TWISTED RETURN CHANNEL VANE

BACKGROUND

Embodiments of the subject matter disclosed herein generally relate to methods and devices and, more particularly, to mechanisms and techniques for designing return channel vanes for increasing centrifugal compressor efficiency or reducing centrifugal compressor size and cost without affecting the performance of the centrifugal compressor.

Centrifugal compressors are utilized extensively in many industries today across a wide variety of applications. A consistent request, from users of centrifugal compressors to the manufacturers of centrifugal compressors, is to produce a machine with smaller size and lower cost having the same performance characteristics of the existing generation of centrifugal compressor. Implicit in this request is the necessity of improving the efficiency of a gal compressor such that reducing the size of the centrifugal compressor results in a lower cost machine without reducing the performance of the machine.

Centrifugal compressors generally have multiple stages and return channels, with fixed vanes, for redirecting the compressed gas from the exit location of one stage to the entry location of the next stage and for removing the tangential component of the flow. The design of the vanes associated with the return channels is important for optimizing the performance of the centrifugal compressor.

Illustrated in prior art FIG. 1 is a return channel 102, including a return channel vane 104 and a rotor vane 106. It should be noted that the return channel vane 104 does not extend to the bend apex 108 of the return channel 102.

Accordingly, it would be desirable to provide designs and methods that increase the performance of a given centrifugal compressor or reduce the size and cost of a centrifugal compressor without reducing the capacity of the centrifugal compressor.

SUMMARY

According to one exemplary embodiment, there is a return channel assembly apparatus for a centrifugal compressor; the apparatus comprises a plurality of identical return channels, wherein the plurality of return channels are arranged to bend, by a total of at least 180°, fluid streams flowing through the return channels; the apparatus comprises further: a plurality of identical return channel vanes extending up to or beyond a corresponding plurality of regions proximate a bend apex of the corresponding plurality of return channels, wherein said regions extend radially from the apex into the corresponding return channel, wherein at said regions the fluid streams have already been bent by approximately 90°; a hub having a hub surface with an axial symmetry; a shroud having a shroud surface with an axial symmetry; a hub beta angle is an angle at a point of a hub camber line, and corresponds to the acute angle between the tangent to the hub camber line at said point and the tangent to the circumference lying in the hub surface and passing at said point; a shroud beta angle is an angle at a point of a shroud camber line, and corresponds to the acute angle between the tangent to the shroud camber line at said point and the tangent to the circumference lying in the shroud surface and passing at said point; in the apparatus an angular difference between hub beta angle and shroud beta angle at a point having the same normalized distance from the leading edge of a vane of a return channel moving from the leading edge to the trailing edge of said vane of said return channel, first decreases reaching a minimum angular difference, then increases reaching a maximum angular difference, then decreases again.

According to another exemplary embodiment, there is a centrifugal compressor apparatus comprising a casing enclosing a rotor and a stator, and a return channel assembly apparatus as set out above.

According to another exemplary embodiment, there is a method for maintaining the performance of a centrifugal compressor while reducing the size of the centrifugal compressor; the compressor comprises a plurality of identical return channels arranged to bend, by a total of at least 180°, fluid streams flowing through the return channels. The method comprises extending a plurality of identical return channel vanes up to or beyond a corresponding plurality of regions proximate a bend apex of the corresponding plurality of return channels, where the fluid streams have already been bent by approximately 90°. Furthermore, the method may comprise arranging the return channel vanes so that an angular difference between hub beta angle and shroud beta angle at a point having the same normalized distance from the leading edge of a vane moving from the leading edge to the trailing edge of said vane, first decreases reaching a minimum angular difference, then increases reaching a maximum angular difference, then decreases again.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of turbo-machinery including but not limited to compressors and expanders.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 2:
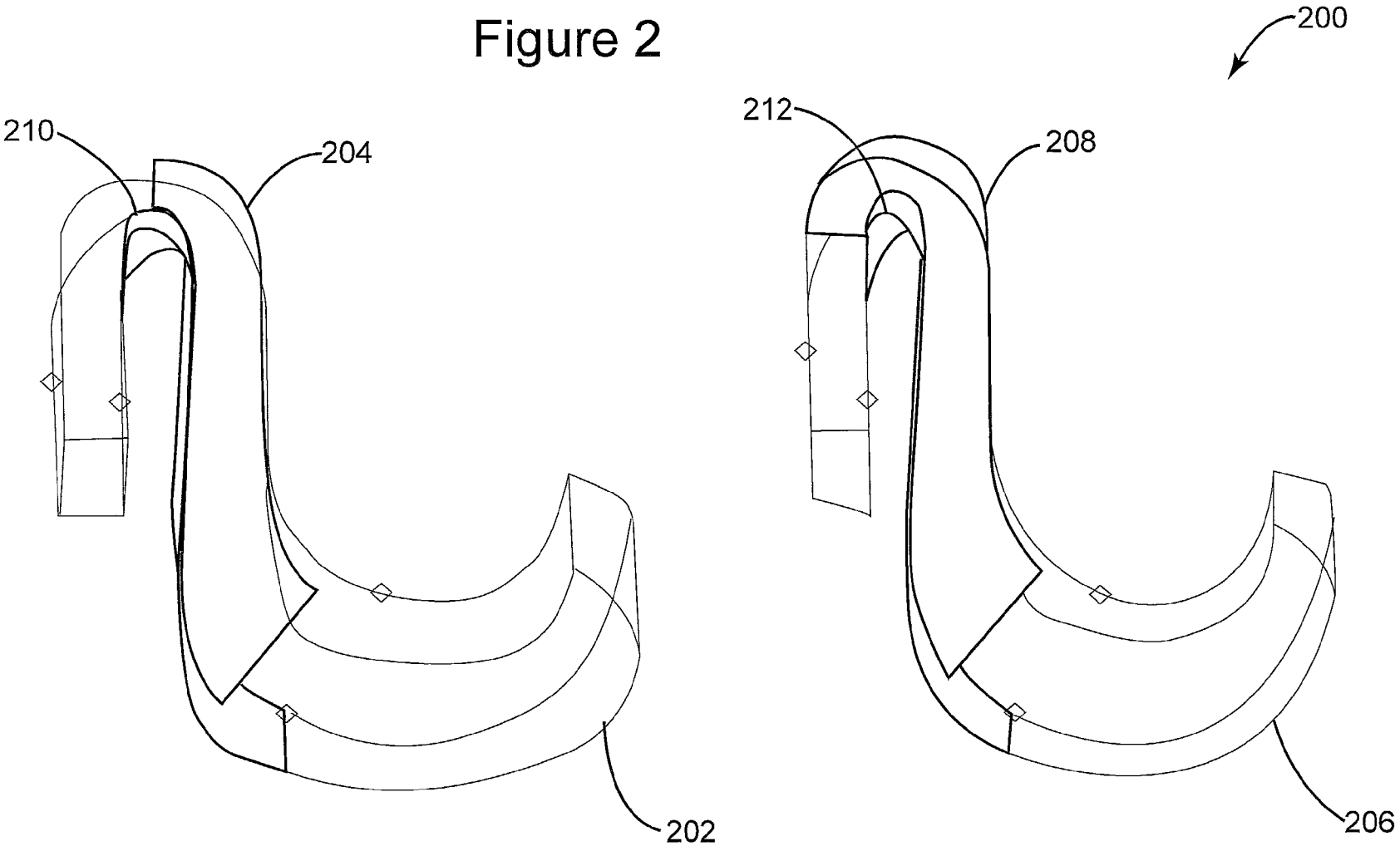
FIG. 2 is an exemplary embodiment depicting a pair of centrifugal compressor return channels including a return channel vane extending to the return channel bend apex and a return channel vane extending beyond the return channel bend apex.

As shown in FIG. 2, an exemplary embodiment 200 depicts a first centrifugal compressor return channel 202 with a return channel vane 204, which can be referred to as a "half boomerang" vane and a second return channel 206 with a return channel vane 208, which can be referred to as a "full boomerang" vane. It should be noted in the exemplary embodiment that the half boomerang vane 204 extends to the bend apex 210 of the return channel 202. It should further be noted in the exemplary embodiment that the full boomerang vane 208 extends beyond the bend apex 212 of the return channel 206, making an approximately one hundred eighty degree turn in the return channel 206. Thus, a set of embodiments which includes both the half boomerang and the full boomerang return channel vanes (as well as other geometries) can be characterized as having return channel vanes which extend up to or beyond a region (see ellipses in dashed line in FIGS. 2 and 3) proximate the bend apex or the bend entry of the return channel; at this region the fluid stream flowing in the return channel has already been bent by approximately 90° (in the meridional plane); it is to be noted that, typically, a compressor comprises at least one plurality of identical return channels arranged to bend, by a total of at least 180°, fluid streams flowing through the return channels.

Figure 1:
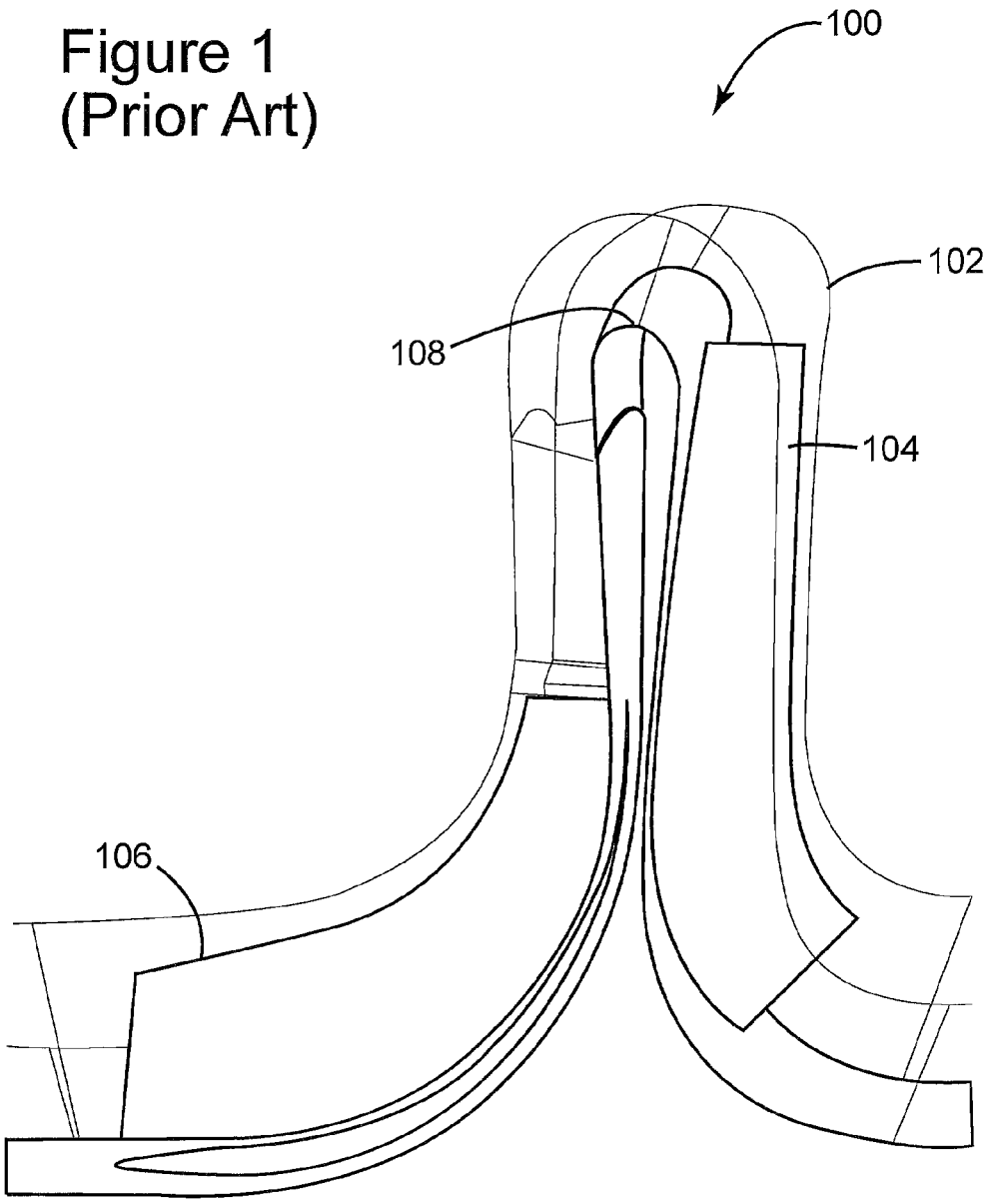
Figure 1 (Prior Art)
FIG. 1 is a prior art exemplary embodiment depicting a centrifugal compressor return channel including a return channel vane and a rotor vane.
Figure 3:
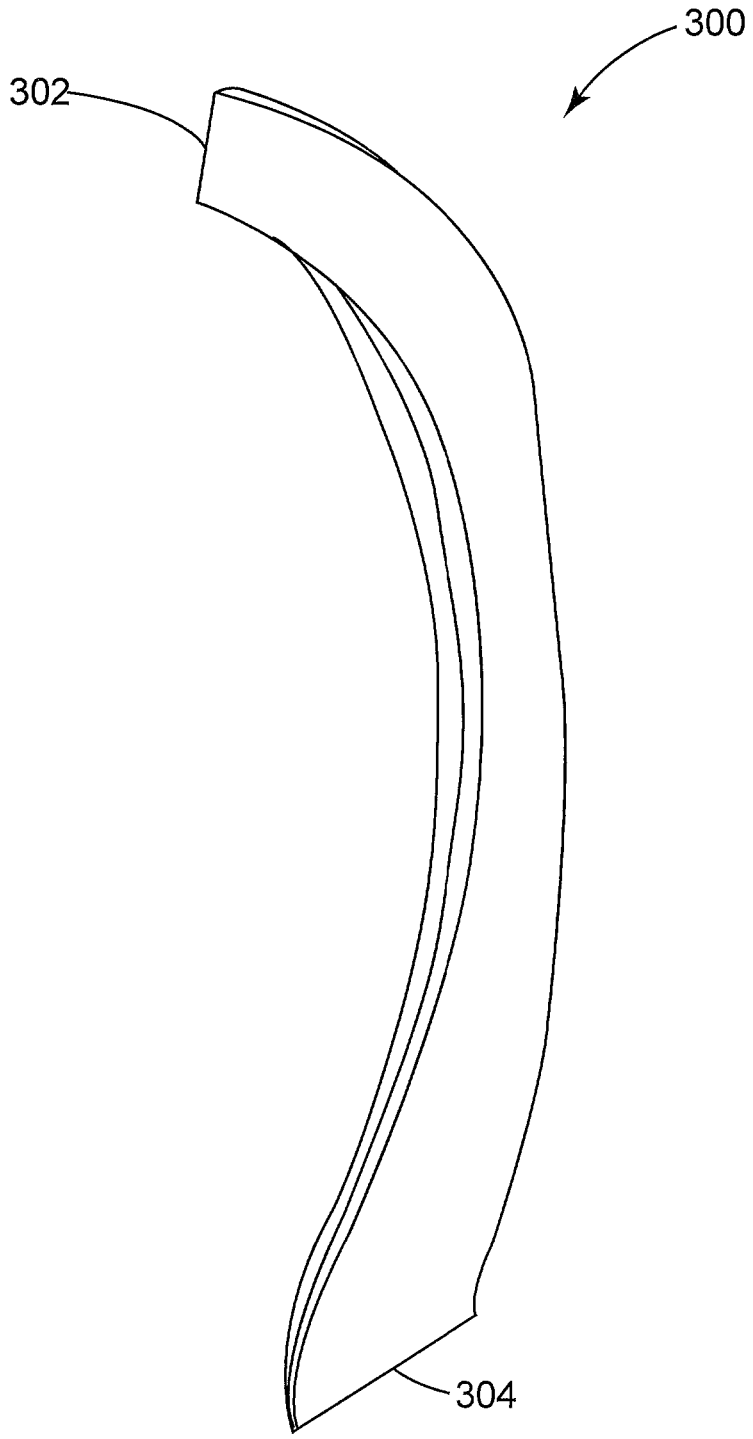
FIG. 3 is an exemplary embodiment depicting a three-dimensional depiction of a centrifugal compressor return channel vane.

Looking now to FIG. 3, a three dimensional exemplary embodiment of a return channel vane 300 is depicted. The exemplary embodiment return channel vane has a bend apex end 302 directed toward the outer circumference of an associated hub surface and a vane end 304 directed toward the inner circumference of an associated hub surface. The return channel vane 300 is of a half boomerang design as the bend apex end 302 of the return channel vane 300 does not have a one hundred eighty degree turn at the bend apex end 302. It should be noted in the exemplary embodiment that by extending the leading edge of the bend apex end 302 of the return channel vane 300, pressure recovery starts earlier in the return channel passage and due to lower fluid velocities particularly in the section of the conventional return channel vanes 104 of FIG. 1, the kinetic losses in the return channel are decreased. It should further be noted in the exemplary embodiment that due to the increase in surface area of the vane based on the extended length, a smaller number of return channel vanes 300 are required for a given centrifugal compressor.

Figure 4:
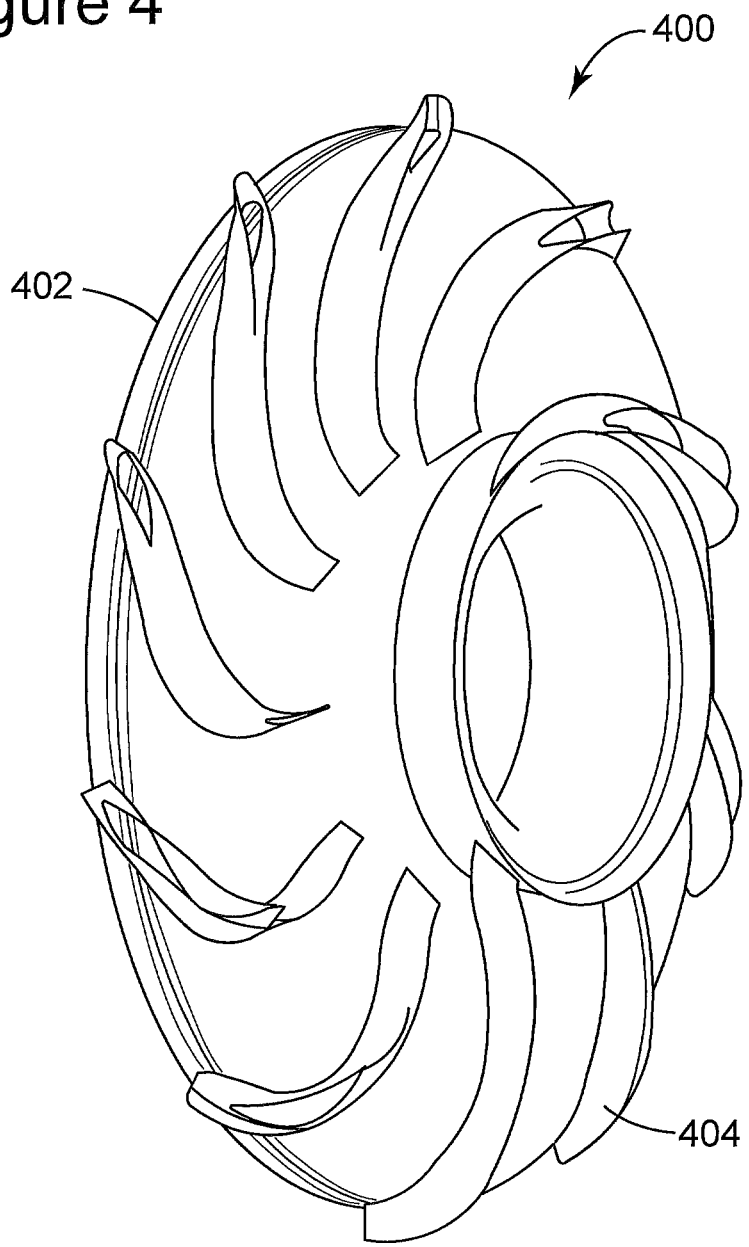
FIG. 4 is an exemplary embodiment depicting a plurality of centrifugal compressor return channel vanes and an associated hub surface.

Looking now to FIG. 4, an exemplary embodiment of a hub 402 associated with a plurality of return channel vanes, represented by return channel vane 404, is depicted. It should be noted in this exemplary embodiment depiction that the return channel vanes are half boomerang vanes.

Figure 5:
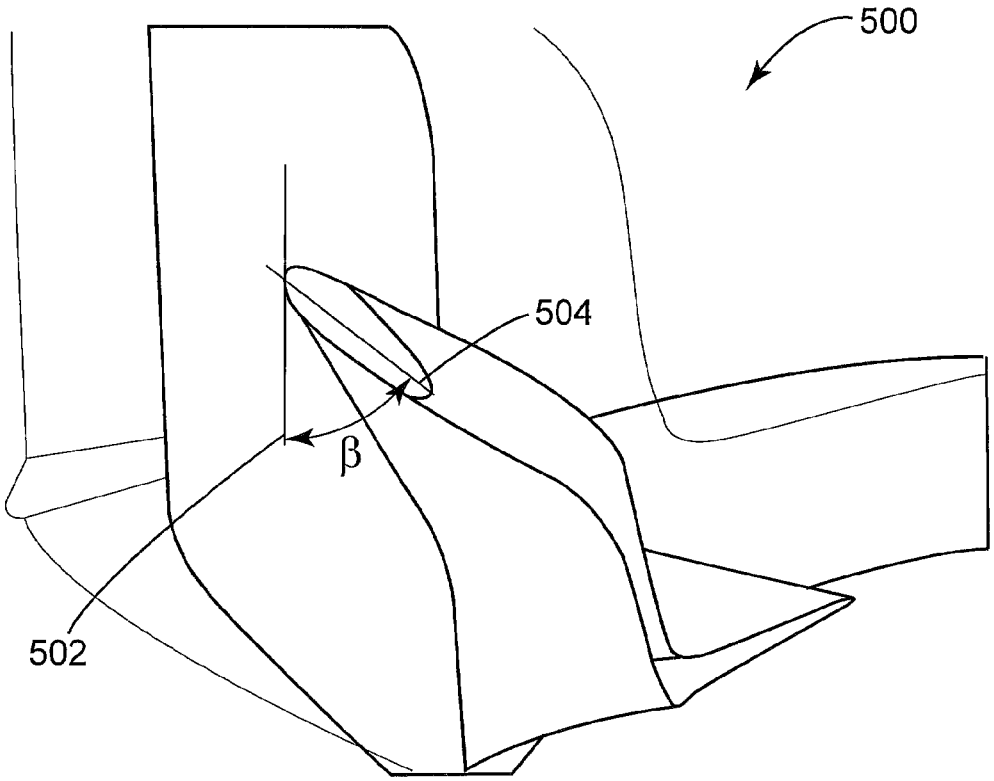
FIG. 5 is an exemplary embodiment depicting a beta angle as the local angle between the camber line and the circumferential direction of a return channel vane.

Turning now to FIG. 5, an exemplary embodiment depicts a specific example of the beta angle of a return channel vane, i.e., the local angle measured between the return channel vane's camber line and the circumferential coordinate direction. Continuing with the exemplary embodiment, the return channel vane beta angle distributions as a function of meridional coordinates are defined by, for example, using scalable and parameterized elliptic and/or Bezier functions. It will be appreciated by those skilled in the art that the embodiments are not limited to using elliptic and/or Bezier functions to define the beta angle distributions but that other functions (e.g., spline functions) could alternatively be used to render such definitions. It should also be noted in the exemplary embodiment that return channel vane thickness distribution is defined similarly. It should further be noted in the exemplary embodiment that, as stated previously, the vane beta angle is defined relative to a circumferential coordinate, i.e., zero degrees is purely circumferential flow and ninety degrees is purely meridional flow, i.e., axial or radial or anything in between.

Figure 6:
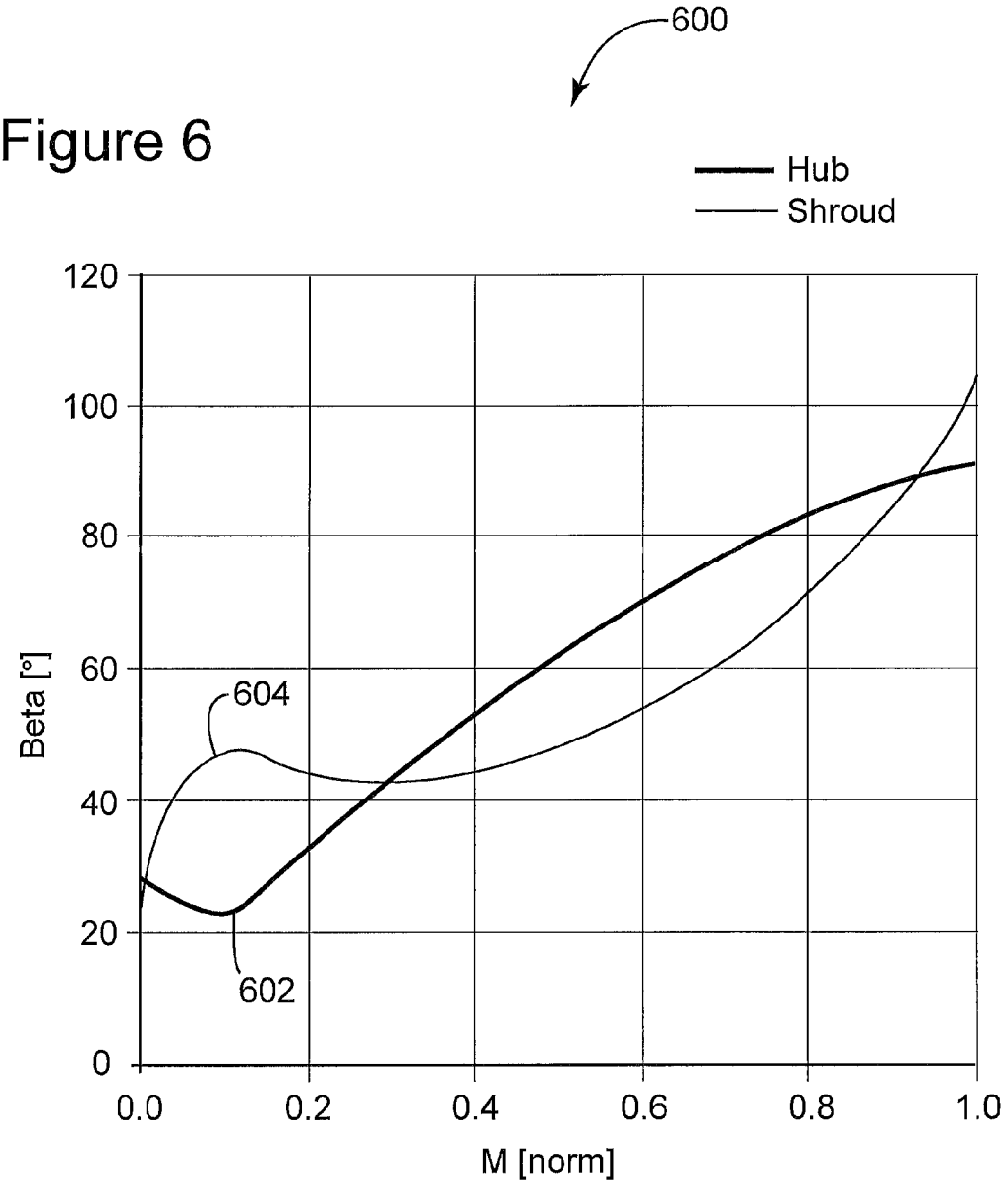
FIG. 6 is a graph depicting beta angles of a return channel vane at the hub and at the shroud.
Figure 7:
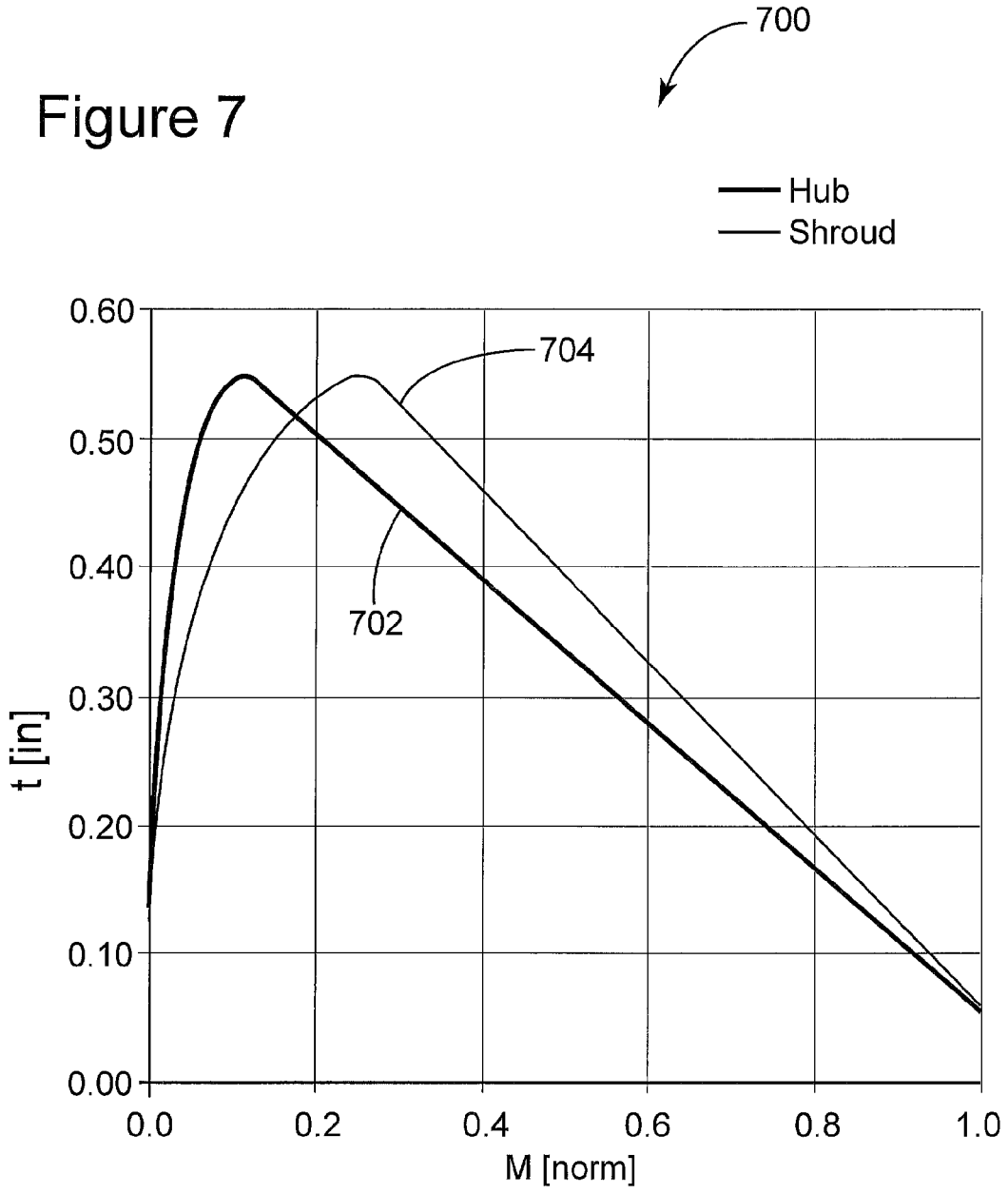
FIG. 7 is a graph depicting the thickness of a return channel vane at the hub and at the shroud.

Continuing to FIG. 6, a graph 600 represents the vane beta angle distribution along the hub and shroud surfaces of the exemplary embodiment hub and shroud beta angles; it is to be noted that, in these plots, the horizontal axis is used for the distance of a considered point from the leading edge of the vane along the camber line divided by the total length of the camber line; i.e. the normalized distance M of the point; therefore for a point at the leading edge M=0.0, for a point at the trailing edge M=1.0 and for points at a camber line between the leading edge and the trailing edge $0.0<M<1.0$. Continuing with the exemplary embodiment and as previously described, the return channel vane leading edge is extended to or beyond the return channel bend apex. Further in the exemplary embodiment, the hub beta angle 602 first decreases to a minimum and then continuously increases while the shroud beta angle 604 first increases to a local maximum then forms the distinct shape displayed in the graph 600. It should be noted in the exemplary embodiment that the hub and shroud beta angle distributions are defined by a quarter-ellipse equation in the first portion, i.e., from the angle axis of graph 600 to the minimum and localized maximum for the hub beta angle and the shroud beta angle, respectively. It should further be noted in the exemplary embodiment that the remaining portion is calculated using Bezier functions with different number of control points. Looking also to FIG. 7, a graph 700 represents vane thickness along the hub 702 and along the shroud 704. It should be noted in the exemplary embodiment that a similar method as described for the beta angle distributions is used to describe the return channel vane thickness.

Figure 8:
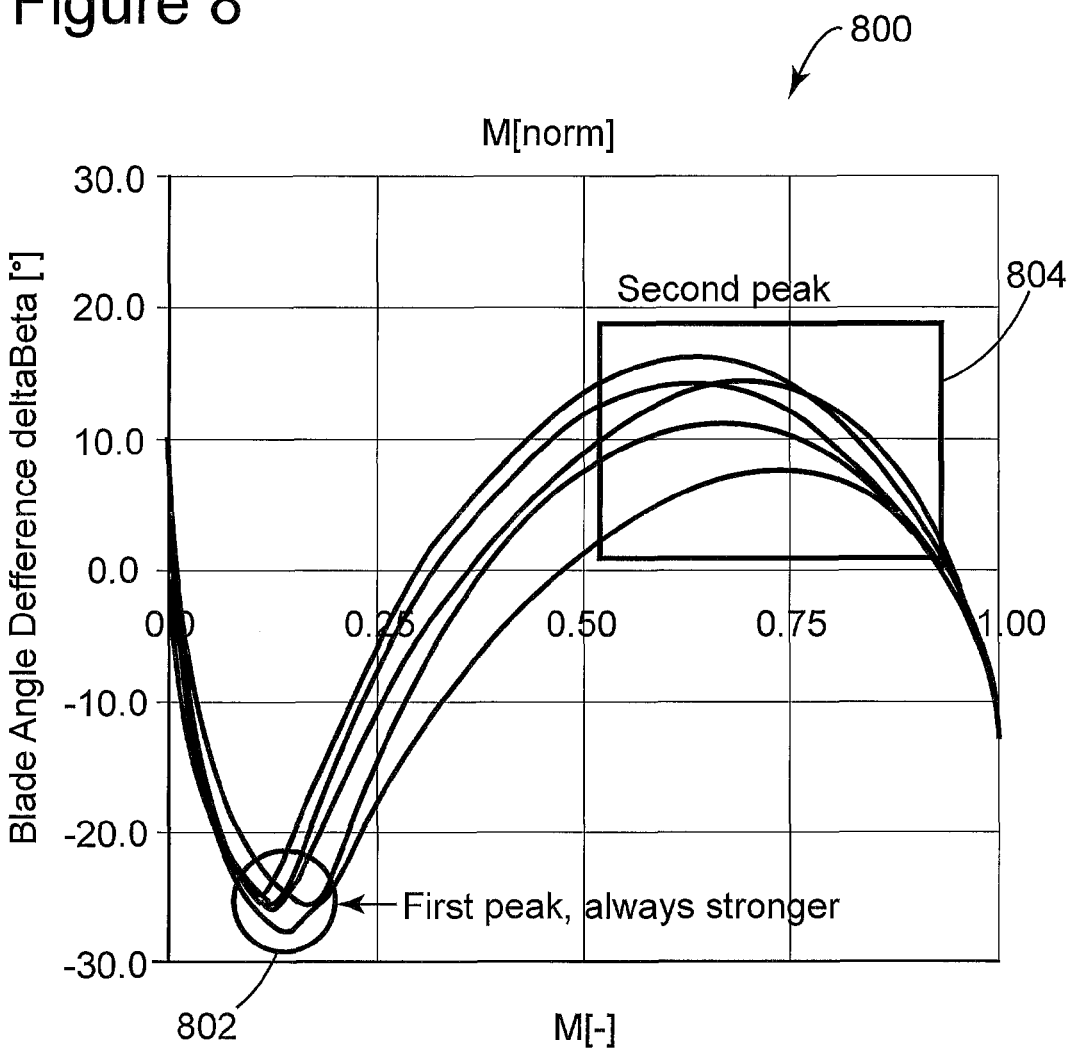
FIG. 8 is a graph depicting the vane angle difference along the meridional length.

Looking next to FIG. 8, a graph 800 depicts the difference in the beta angle of the exemplary embodiment along the hub surface and the shroud surface. Next in the exemplary embodiment, the vane angle difference, deltaBeta, is calculated as $\text{deltaBeta}=\text{Beta}_{hub}-\text{Beta}_{shroud}$. Continuing with the exemplary embodiment, the angular difference, deltaBeta, defined above first decreases reaching a minimum 802, then increases reaching a maximum 804, then decreases again without reaching the minimum 802. It should be noted in the exemplary embodiment that the absolute value of the minimum 802 is always larger than the absolute value of the maximum 804 and the minimum 802 lies within the first quarter of meridian length whereas the maximum 804 lies behind the mid chord. It should further be noted in the exemplary embodiment that the trailing edge angle difference varies based on the design.

Figure 9:
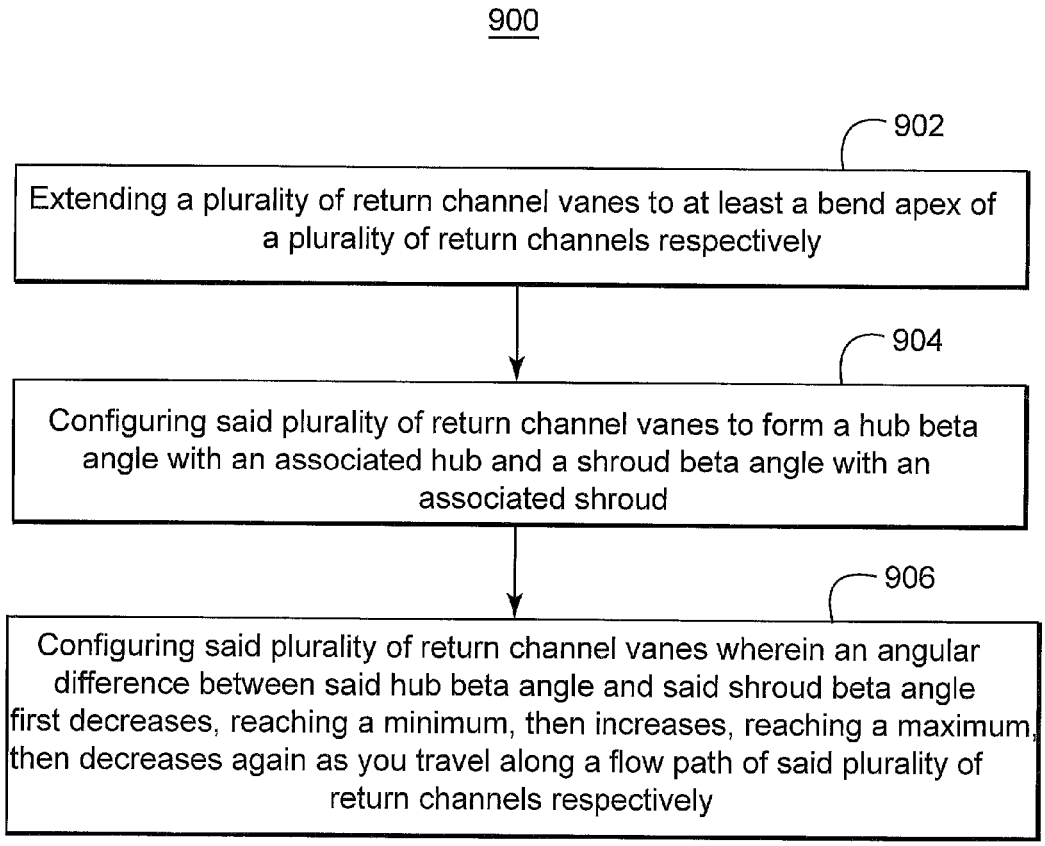
FIG. 9 is a flow chart illustrating steps for maintaining the performance of a centrifugal compressor while reducing the size of the centrifugal compressor.

Looking now to FIG. 9, a flowchart 900 of an exemplary method embodiment for either maintaining the performance of a centrifugal compressor while reducing the size of the centrifugal compressor or increasing the peak performance of a given centrifugal compressor is depicted. First at step 902 of the exemplary embodiment, the plurality of return channel vanes are extended to a region proximate a bend apex of the plurality of return channels respectively. Increasing the size, i.e., length, of the return channel vanes initiates the pressure recovery earlier in the passage and, due to the lower flow velocities, kinetic losses in the return channel are decreased. Further in the exemplary method embodiment, because of the associated increase in surface area of the return channel vanes, a smaller number of return channel vanes are required for a given centrifugal compressor.

Next at step 904 of the exemplary method embodiment, the return channel vanes are configured such that they form a hub beta angle along an associated hub and a shroud beta angle along an associated shroud. The hub beta angle and the shroud beta angle are local angles measured between return channel vane camber lines and circumferential directions. Continuing with the exemplary method embodiment, the hub beta angle first decreases to a minimum and then increases continuously. Further in the exemplary embodiment, the shroud beta angle first increases to a local maximum then decreases before increasing again continuously. It should be noted in the exemplary method embodiment that both the hub and shroud beta angles are calculated based on, for example, a quarter-ellipse function from the beginning of the flow path to the minimum/maximum respectively and based on a Bezier function, with a different number of control points, from the minimum/maximum to the end of the flow path, respectively. Other functions may, alternately, be used to define the hub and/or shroud beta angles.

Next at step 906 of the exemplary method embodiment, the return channel vanes are further configured wherein an angular difference between the hub beta angle and the shroud beta angle along a flow path of a return channel first decreases reaching a minimum angular difference, then increases reaching a maximum angular difference, then decreases again. It should be noted in the exemplary embodiment that the absolute value of the minimum angular difference is larger than the absolute value of the maximum angular difference. It should be noted further that the minimum angular difference lies within the first quarter of meridian length and the maximum angular difference lies beyond the mid-chord of the flow path.

The disclosed exemplary embodiments provide a device and a method for reducing the size of a centrifugal compressor while maintaining the performance characteristic of the larger centrifugal compressor or increasing the peak efficiency of a given centrifugal compressor. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements to those recited in the literal languages of the claims.

In the following, some clarifications regarding the terminology used in the description and claims will be provided with reference to FIG. 10 and FIG. 11; it is to be noted that these figures do not correspond to any embodiment of the present invention; it is also to be noted that such clarifications are obvious for a person skilled in the art.

Figure 10:
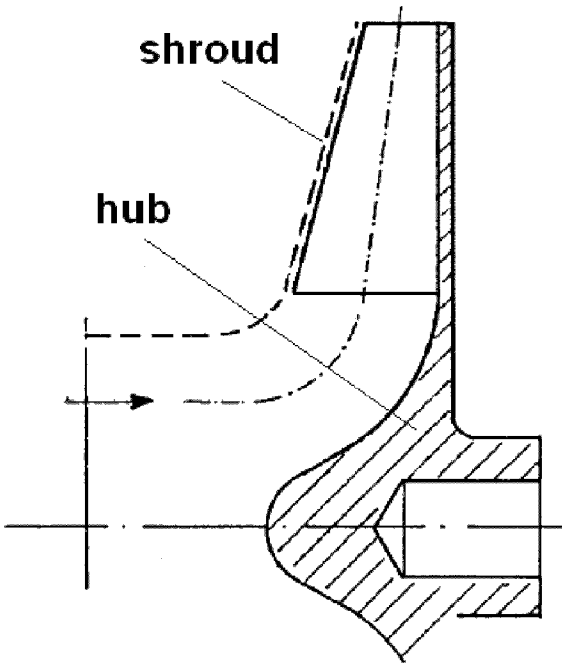

In FIG. 10, there is shown a vane of an impeller located between a hub and a shroud (shown by a dashed line) and adjacent to the vane; the hub has a hub surface having an axial symmetry (it is similar to a cone surface); the shroud has a shroud surface having an axial symmetry (it is similar to a cone surface).

Figure 11:
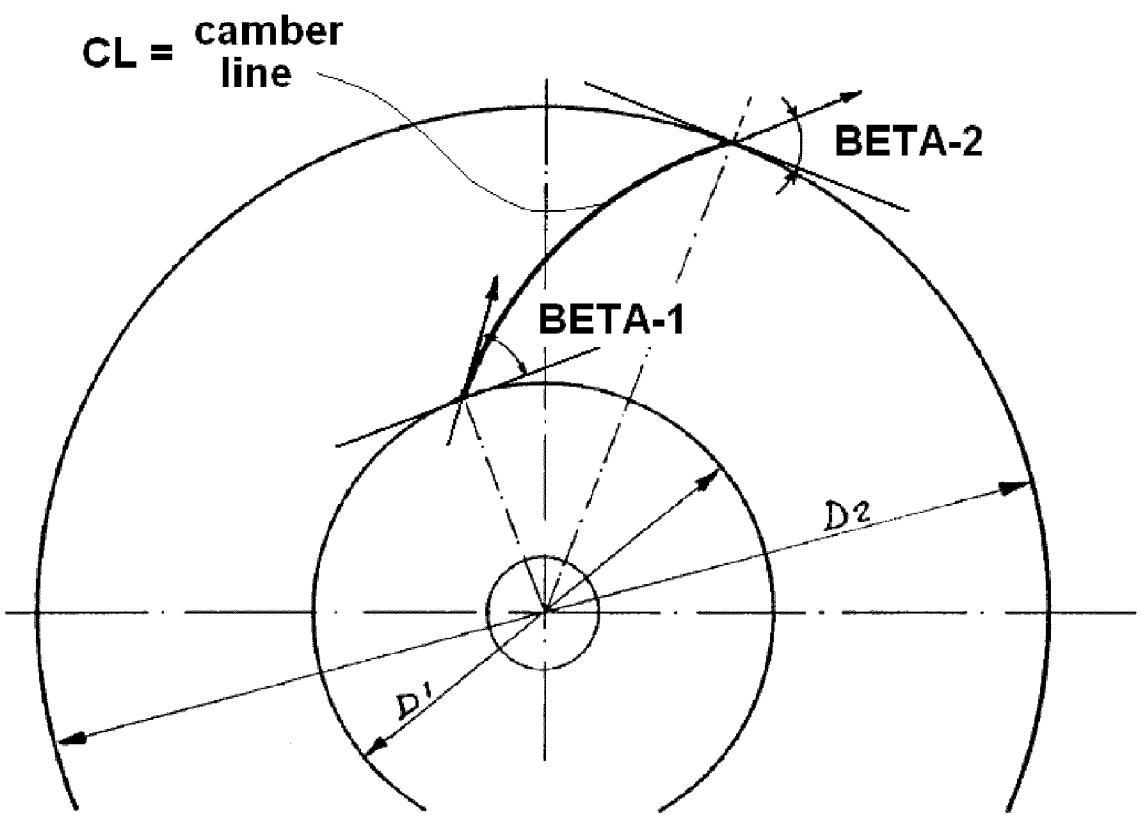
FIG. 10 and FIG. 11 are two schematic views of a vane of an impeller located between a hub and a shroud (shown as a dashed line only in FIG. 10) that helps in understanding what beta angles are.

In FIG. 11, a camber line CL of the vane of FIG. 10 is shown; a vane is associated to a plurality of camber lines; moving from the hub to the shroud, each point of the airfoil surface of vane is associated to a distinct and different camber line; the camber line associate to a point of the airfoil surface of vane located on the hub surface is usually called "hub camber line"; the camber line associate to a point of the airfoil surface of vane located on the shroud surface is usually called "shroud camber line".

A beta angle is an angle at a point of a camber line and lying in a place orthogonal to the axis of the impeller, and corresponds to the acute angle between the tangent (lying in said plane) to the camber line at said point and the tangent (lying in said plane) to the circumference lying lying in said plane and passing at said point; in FIG. 11, BETA-1 is the beta angle of camber line CL at the leading edge of the vane and BETA-2 is the beta angle of camber line CL at the trailing edge of the vane. A hub beta angle is an angle at a point of a hub camber line, and corresponds to the acute angle between the tangent to the hub camber line at said point and the tangent to the circumference lying in the hub surface and passing at said point; a shroud beta angle is an angle at a point of a shroud camber line, and corresponds to the acute angle between the tangent to the shroud camber line at said point and the tangent to the circumference lying in the shroud surface and passing at said point.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A return channel assembly apparatus for a centrifugal compressor, the apparatus comprising:

a plurality of identical return channels, wherein the plurality of return channels are arranged to bend, by a total of at least 180°, fluid streams flowing through the plurality of return channels;

a plurality of identical return channel vanes extending up to or beyond a corresponding plurality of regions proximate a bend apex of the corresponding plurality of return channels, wherein the regions extend radially from the bend apex into the corresponding return channel, wherein at the regions the fluid streams have already been bent by approximately 90°;

a hub comprising a hub surface with an axial symmetry; and a shroud comprising a shroud surface with an axial symmetry, wherein a hub beta angle is an angle at a point of a hub camber line, and corresponds to the acute angle between the tangent to the hub camber line at the point of the hub camber line and the tangent to the circumference lying in the hub surface and passing at the point of the hub camber line, wherein a shroud beta angle is an angle at a point of a shroud camber line, and corresponds to the acute angle between the tangent to the shroud camber line at the point of the shroud camber line and the tangent to the circumference lying in the shroud surface and passing at the point of a shroud camber line, and wherein an angular algebraic difference of hub beta angle minus shroud beta angle at a point having the same normalized distance from the leading edge of a vane of a return channel moving from the leading edge to the trailing edge of the vane of the return channel, first decreases reaching a minimum algebraic angular difference, then increases reaching a maximum angular algebraic difference, then decreases again.

2. The apparatus of claim 1, wherein leading edges of the plurality of return channel vanes are located entirely in the regions of the corresponding plurality of return channels.

3. The apparatus of claim 1, wherein axial portions of the plurality of return channel vanes that extend radially are located entirely in the regions of the corresponding plurality of return channels.

4. The apparatus of claim 1, wherein absolute value of the minimum angular algebraic difference is greater than absolute value of the maximum angular algebraic difference.

5. The apparatus of claim 1, wherein the hub beta angle decreases to a minimum then continuously increases moving from the leading edge to the trailing edge of the vane of the return channel.

6. The apparatus of claim 5, wherein a plot of the hub beta angle is described by a hub Bezier function from the minimum onwards.

7. The apparatus of claim 6, wherein the hub Bezier function uses a varying number of control points.

8. The apparatus of claim 5, wherein a plot of the hub beta angle is described by a quarter-ellipse function before the minimum.

9. The apparatus of claim 1, wherein the shroud beta angle increases to a local maximum, then decreases to a minimum, then continuously increases moving from the leading edge to the trailing edge of the vane of the return channel.

10. The apparatus of claim 9, wherein a plot of the shroud beta angle is described by a shroud Bezier function from the local maximum onwards.

11. The apparatus of claim 10, wherein the shroud Bezier function uses a varying number of control points.

12. The apparatus of claim 9, wherein a plot of the shroud beta angle is described by a quarter-ellipse function before the local maximum.

13. A centrifugal compressor apparatus comprising:

a casing enclosing a rotor and a stator; and a return channel assembly apparatus, comprising:

a plurality of identical return channels, wherein the plurality of return channels are arranged to bend, by a total of at least 180°, fluid streams flowing through the plurality of return channels;

a plurality of identical return channel vanes extending up to or beyond a corresponding plurality of regions proximate a bend apex of the corresponding plurality of return channels, wherein the regions extend radially from the bend apex into the corresponding return channel, wherein at the regions the fluid streams have already been bent by approximately 90°;

a hub comprising a hub surface with an axial symmetry; and a shroud comprising a shroud surface with an axial symmetry, wherein a hub beta angle is an angle at a point of a hub camber line, and corresponds to the acute angle between the tangent to the hub camber line at the point of the hub camber line and the tangent to the circumference lying in the hub surface and passing at the point of the hub camber line, wherein a shroud beta angle is an angle at a point of a shroud camber line, and corresponds to the acute angle between the tangent to the shroud camber line at the point of the shroud camber line and the tangent to the circumference lying in the shroud surface and passing at the point of a shroud camber line, and wherein an angular algebraic difference of hub beta angle minus shroud beta angle at a point having the same normalized distance from the leading edge of a vane of a return channel moving from the leading edge to the trailing edge of the vane of the return channel, first decreases reaching a minimum algebraic angular difference, then increases reaching a maximum angular algebraic difference, then decreases again.

14. The apparatus of claim 13, wherein leading edges of the plurality of return channel vanes are located entirely in the regions of the corresponding plurality of return channels.

15. The apparatus of claim 13, wherein axial portions of the plurality of return channel vanes that extend radially are located entirely in the regions of the corresponding plurality of return channels.

16. The apparatus of claim 13, wherein absolute value of the minimum angular algebraic difference is greater than absolute value of the maximum angular algebraic difference.

17. The apparatus of claim 13, wherein the hub beta angle decreases to a minimum then continuously increases moving from the leading edge to the trailing edge of the vane of the return channel.

18. The apparatus of claim 13, wherein the shroud beta angle increases to a local maximum, then decreases to a minimum, then continuously increases moving from the leading edge to the trailing edge of the vane of the return channel.

19. A method for maintaining the performance of a centrifugal compressor while reducing the centrifugal compressor size or increasing the peak performance of a centrifugal compressor, wherein the compressor comprises a plurality of identical return channels arranged to bend, by a total of at least 180°, fluid streams flowing through the return channels, the method comprising:

extending a plurality of identical return channel vanes up to or beyond a corresponding plurality of regions proximate a bend apex of the corresponding plurality of return channels, where the fluid streams have already been bent by approximately 90°; and arranging the return channel vanes so that an angular algebraic difference of hub beta angle minus shroud beta angle at a point having the same normalized distance from the leading edge of a vane moving from the leading edge to the trailing edge of the vane, first decreases reaching a minimum angular algebraic difference, then increases reaching a maximum angular algebraic difference, then decreases again, wherein a hub beta angle is an angle at a point of a hub camber line, and corresponds to the acute angle between the tangent to the hub camber line at the point of the hub camber line and the tangent to the circumference lying in the hub surface and passing at the point of the hub camber line, and wherein a shroud beta angle is an angle at a point of a shroud camber line, and corresponds to the acute angle between the tangent to the shroud camber line at the point of the shroud camber line and the tangent to the circumference lying in the shroud surface and passing at the point of the shroud camber line.

* * * * *